US005956788A

United States Patent [19]

Henke

[11] Patent Number: 5,956,788

[45] Date of Patent: Sep. 28, 1999

[54] ERGONOMIC, SINGLE HAND, FOLDING PAINTER'S TOOL

[75] Inventor: David R. Henke, Maple Grove, Minn.

[73] Assignee: Warner Manufacturing Company, Minneapolis, Minn.

[21] Appl. No.: 08/899,217

[22] Filed: Jul. 23, 1997

[51] Int. Cl.[6] ..... B44C 7/00

[52] U.S. Cl. ..... 7/105; 7/167

[58] Field of Search ..... 7/105, 118, 167, 7/168; 30/158, 161, 169

[56] References Cited

U.S. PATENT DOCUMENTS

| | | | |
|---|---|---|---|
| 28,738 | 5/1860 | Hamlis . | |
| 180,187 | 7/1876 | Bartlett . | |
| 508,273 | 11/1893 | Brauch . | |
| 825,063 | 7/1906 | Lawbaugh . | |
| 832,455 | 6/1906 | Christensen . | |
| 1,015,026 | 1/1912 | Jackson et al. . | |
| 2,092,586 | 9/1937 | Naumovich . | |
| 2,213,071 | 8/1940 | Keller . | |
| 2,839,110 | 6/1958 | Carpenter . | |
| 3,774,252 | 11/1973 | Cantales . | |
| 4,095,337 | 6/1978 | Pharr . | |
| 4,271,592 | 6/1981 | Höptner . | |
| 4,805,303 | 2/1989 | Gibbs . | |
| 4,819,289 | 4/1989 | Gibbs . | |
| 4,890,387 | 1/1990 | Canino . | |
| 5,009,008 | 4/1991 | Yablonovitch . | |
| 5,044,079 | 9/1991 | Gibbs . | |
| 5,063,627 | 11/1991 | Marra . | |
| 5,251,352 | 10/1993 | Cullison . | |
| 5,365,666 | 11/1994 | Gonzalez | 7/167 X |
| 5,495,673 | 3/1996 | Gardiner et al. . | |
| 5,502,895 | 4/1996 | Lemaire . | |
| 5,537,750 | 7/1996 | Seber et al. | 7/118 X |
| 5,546,625 | 8/1996 | Mealey, Sr. . | |
| 5,769,094 | 6/1998 | Jenkins et al. | 30/161 |

OTHER PUBLICATIONS

Tom Baldwin, Sketch of an idea submitted to the Assignee on Jul. 15, 1994.

*Primary Examiner*—James G. Smith
*Attorney, Agent, or Firm*—Merchant, Gould, Smith, Edell, Welter & Schmidt, P.A.

[57] ABSTRACT

An easy to hold, single hand operated, foldable, multi-purpose painter's tool for use in performing a variety of tasks, such as scraping, spreading, cleaning, cutting, and can opening, encountered during painting. The tool includes an elongate handle having first and second side walls defining first and second edges and first and second ends, and a channel formed between the side walls and extending through the first edge. An elongate blade is secured by a pivot at a first end to the first end of the handle, permitting the blade to pivot between a folded position within the channel, and an extended position outside of the channel. The blade itself defines first and second side surfaces, first and second longitudinal edges and an orthogonal edge at a second end of the blade. A rounded notch is formed in each of the side walls of the handle at the first edge, and a finger actuation knob is detachably secured to one of the side surfaces adjacent to the first longitudinal edge, such that when the blade is in the folded position, the finger actuation knob is disposed within one of the rounded notches. The knob can be secured to either side of the blade to accommodate both right and left handed users.

26 Claims, 1 Drawing Sheet

ERGONOMIC, SINGLE HAND, FOLDING PAINTER'S TOOL

FIELD OF THE INVENTION

The present invention relates to a tool, in particular a multi-purpose, folding painter's tool.

BACKGROUND OF THE INVENTION

A wide variety of tools have been developed in the past for use during painting operations to perform such tasks as scraping, spreading, cutting, opening paint cans, and the like. Generally, these tools are designed such that a tool is able to perform a single task, or they are designed such that a tool performs multiple tasks. In many instances, a multi-task tool is preferred since it reduces the number of tools which need to be used, thus reducing cost to the user and making the painting operation easier.

A problem with these conventional tools, whether single task or multiple task, is that they are rather large and bulky, making them difficult, if not impossible, to be conveniently carried by the user so as to be ready for use if the need arises, and making them difficult to store when not in use. Further, many of these tools have blade portions with sharp edges and points, making them dangerous to both the user and others, particularly while ascending and descending ladders, scaffolding, and the like. Often times with tools of this sort, a separate carrying pouch or sheath, usually made of leather, is utilized to carry or encase the blade portion of the tool, with the pouch being worn by the user by being secured to the users belt, in order to protect the user from the blade portion. However, the pouch is an added expense in addition to the expense of the tool, and often times gets in the way of the user.

Tools, such as the well known folding knife, have been developed where a blade portion of the tool folds into a handle portion of the tool such that the overall size of the tool is reduced, making it easier and safer to carry. The blade portion is simply pivoted into and out of the handle by the user. However this generally requires the use of both hands by a user. Often times, the user only has one hand free, making the use of these folding knife tools difficult, if not impossible.

U.S. Pat. Nos. 4,095,337 and 5,009,008 have attempted a solution to this problem by attaching an actuator to the blade portion to allow one handed operation of the knives. The user simply attaches the actuator to the blade, permitting the user to open and close the knife by using a finger to push or pull against the actuator. However, these actuators are after market add-ons to the knives, such that the handle of the knives are not designed to accommodate the actuators when the knives are folded whereby the actuators prevent the blade from folding completely into the handle and/or project awkwardly from the handle, detracting from the appearance of the knife and possibly snagging on the user's clothing. Further, since the actuators are attached by the user to the blade, the actuators may at times become loose and fall off of the blade, whereby they may be lost, or at the least rendering one handed operation of the knife impossible.

What has been needed then is a painter's tool having a multi-purpose locking blade, which can fold into a handle thus making it safer while ascending and descending ladders, scaffolding, and the like, and which is specifically designed for one-handed operation.

SUMMARY OF THE INVENTION

Therefore the general purpose of the present invention is to provide an easy to hold, safe, single hand operated, foldable, multi-purpose painter's tool for use in performing a variety of tasks, such as scraping, spreading, cleaning, cutting, and can opening, encountered during painting operations.

A preferred embodiment of the tool in accordance with the principles of the present invention includes an elongate handle having first and second side walls defining first and second edges and first and second ends, and a channel formed between the side walls and extending through the first edge. An elongate blade is secured by a pivot at a first end to the first end of the handle, permitting the blade to pivot between a folded position within the channel, and an extended position outside of the channel. The blade itself defines first and second side surfaces, first and second longitudinal edges and an orthogonal edge at a second end of the blade. A rounded notch is formed in one, preferably both, of the side walls of the handle at the first edge, and a detachable finger actuation knob is detachably secured to either one of the side surfaces adjacent to the first longitudinal edge, such that when the blade is in the folded position, the finger actuation knob is disposed within a respective one of the rounded notches.

One advantage of this type of painter's tool is that the handle is designed with the notch formed therein to accommodate the actuation knob. Therefore, when folded, the blade is fully disposed within the handle and the knob does not project from the handle, which reduces the possibility of the knob tangling with the user's clothing and other objects and maintains the appearance of the tool. Further, the knob permits easy one handed operation of the tool, by allowing a user's thumb or finger to actuate the blade between the folded and extended positions.

The handle is generally tapered from the second end to the first end thereof, and the second handle edge and first handle edge each include a curvilinear finger rest portion adjacent the first handle end. The curvilinear finger rest portions are concave in shape to accommodate a user's thumb or other fingers. The first handle edge further includes an arcuate, concave gripping portion disposed between the rounded notch and the second handle end to accommodate gripping by a user's hand. Thus the handle is ergonomically designed for a user's hand, making use of the tool easier and less tiring to the hand. A hammer cap can be secured to the second end of the handle to allow use of the tool for nail setting.

The blade is designed as a multi-purpose blade to perform multiple tasks. One longitudinal edge of the blade includes a convex portion intermediate the first and second ends thereof, a first concave portion between the convex portion and the second blade end, and a second concave portion between the convex portion and the first end of the blade, while the other longitudinal blade edge includes a third concave portion intermediate the first and second ends. Further, one of the blade side surfaces is beveled adjacent the second blade end and the second longitudinal edge such that a sharpened edge is defined along at least a portion of the orthogonal edge and the second longitudinal edge. The beveling terminates adjacent a vertex of the convex portion such that the sharpened edge ends adjacent the vertex. The orthogonal edge extends generally perpendicular to the first longitudinal edge and is connected thereto by a first radiused portion so as to define a generally large radius corner. The first concave portion of the second longitudinal blade edge includes a first portion extending from the convex portion and an enlarged, second portion connected to the orthogonal edge by a second radiused portion, with the orthogonal edge being disposed at an acute angle relative to the enlarged, second concave portion such that the second radiused portion defines a small radius corner tip. The second radiused portion is disposed generally at a level below the vertex of the convex portion when the blade is extended.

A blade designed according to the principles of the present invention thus includes a scraper, a spreader, a radius scraper, a roller cleaner, a crack cleaner point, a utility knife, and a can opener edge. Therefore the blade is specifically designed to perform a variety of tasks, thus eliminating the need for separate tools to perform each task.

Another feature of the present invention is that the tool includes a locking means for locking the blade in the extended position, and a lock release means at the second edge of the handle for releasing the locking means. By simply actuating the lock release means, the user can fold the blade to the folded position by using a finger to push on the actuation knob in a direction to fold the blade. Thus, one handed operation is obtained, freeing one of the user's hands for other uses.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION

Referring now to the figures, there is illustrated a preferred embodiment of the painter's tool in accordance with the principles of the present invention, the tool being designated by the reference number 10. The tool 10 includes a handle 12 and a blade 14 secured to the handle portion.

Figure 2:
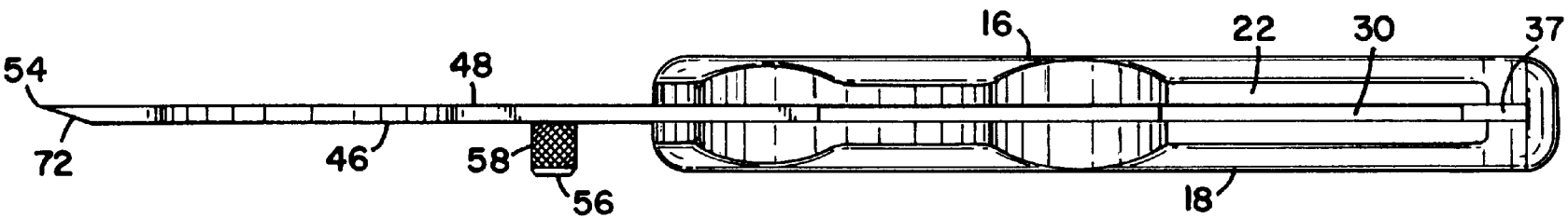
FIG. 2 is a top plan view of the tool shown in FIG. 1.

The handle 12 is generally elongate and is formed from a suitable rigid, metallic, wood or plastic material. A preferred plastic material is a lightweight nylon plastic so as to make the tool 10 light in weight. The handle includes first and second side walls 16,18 which define first and second edges 20,22 and generally first and second ends 24,26. The exterior portions of the side walls 16,18 are generally identical to each other so as to make formation of the side walls easier. The side walls 16,18 are rigidly connected together by fasteners 28*a,b* to form a longitudinal channel 30 therebetween. The channel 30 extends between the edges 20,22 and from the first end 24 to the second end 26. The side walls 16,18 can include surface roughening, such as knurling 32, in order to increase a user's grip on the handle and prevent slipping. Further, a hammer cap 36, preferably made of metal, is secured to the second end 26 for nail setting purposes. As can be seen in FIG. 2, the hammer cap includes a rib 37 extending therefrom and which is disposed within the channel 30 between the side walls 16,18, for spacing the side walls apart at the end 26. The fasteners 28*a* extend between the side walls and through the rib 37, thus securing the hammer cap in place and securing the side walls together at the second end.

Figure 1:
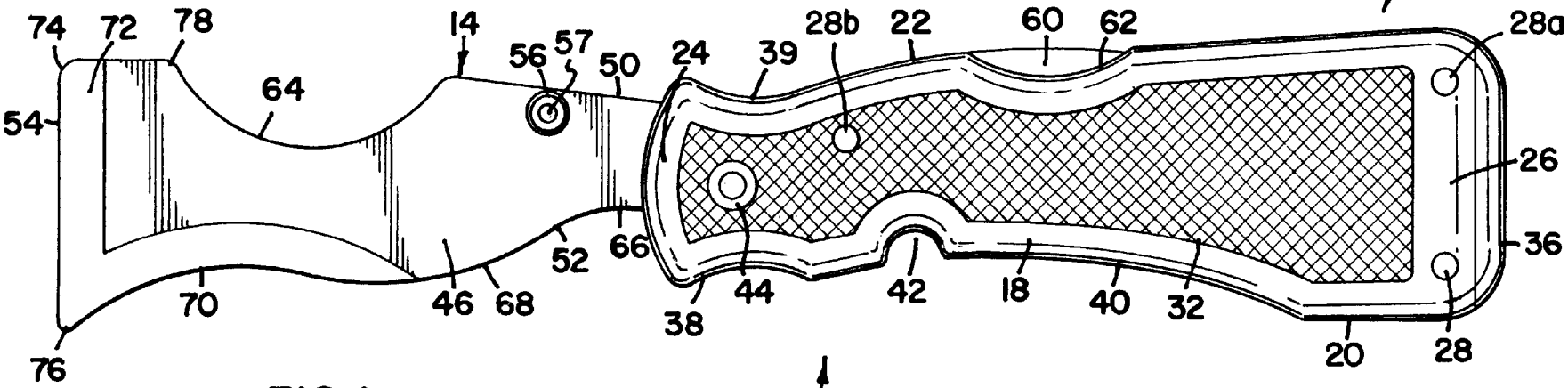
FIG. 1 is a side view of the tool according to the present invention, with the blade in the extended position.

As part of the ergonomic design of the handle, and as can be seen in FIG. 1, the handle is generally tapered from the second end to the first end. Further, the first handle edge 20 includes a curvilinear, preferably concave, finger rest portion 38, and an arcuate, preferably concave, gripping portion 40 extending from the concave portion 38 towards the second end 26. A round notch 42 is formed in the side wall 18 within the concave gripping portion 40, and a round notch (not shown) is also formed in the side wall 16 at a location corresponding to the notch 42. The purpose of the notches will become latter apparent, however the notch 42 is provided to accommodate a right handed user of the tool, while the notch in the side wall 16 is provided to accommodate a left handed user of the tool. The notches could have configurations other than round, such as rectangular or triangular. Further, the edge 22 includes a curvilinear, preferably concave, finger or thumb rest portion 39 adjacent the end 24, and aligned with the rest portion 38.

The blade 14, like the handle 12, is generally elongate, and is made of a metallic material so as to be generally rigid. The blade is connected at one end thereof between the side walls 16,18 by a pivot pin 44 so as to permit the blade to pivot between an extended position, shown in FIGS. 1 and 2, and a folded position wherein the blade is disposed within the channel 30. The blade includes first and second side surfaces 46,48, first and second longitudinal edges 50,52, and an orthogonal edge 54 at a second end of the blade.

As shown, the first side surface 46 includes a round finger actuation knob 56 detachably connected thereto adjacent the first edge 50, in order to accommodate a right handed user. The knob 56 is disposed on the surface 46 such that when the blade is in the folded position, the knob will be disposed within the notch 42. Alternatively, the knob can be removed from the side surface 46 and connected to the second side surface 48 in order to accommodate a left handed user, such that when the blade is in the folded position, the knob will be disposed within the notch in the side wall 16. The knob 56 includes a central, threaded bore 57 extending therethrough which receives a headed, threaded screw (not shown) extending through a suitably located hole (not shown) in the blade, in order to detachably secure the knob to the blade. The screw includes a head (not shown) adjacent the side of the blade which is opposite the knob, with the head including any conventional socket, such as a hexagonal socket for receiving an Allen wrench or a socket for receiving a screw driver, in order to permit actuation of the screw for detachable securement of the knob to either side of the blade. The outer surface of the knob is preferably roughened, such as by knurling 58, to prevent slipping of the user's finger thereon. It should be realized that although the knob 56 is shown as being round, other knob shapes, such as rectangular or square, can be used without changing the scope of the invention. However, the shape of the knob will generally correspond with the shape of the notches to assure proper fit of the knob within the respective notch. Further, although the knob is described as extending from either side of the blade, a knob could be provided which extends from both sides of the blade, in which case the knob would simultaneously accommodate both left and right handed users without requiring the knob to be moved from one side of the blade to the other. In this instance, the notches would receive both of the knob portions extending from the sides of the blade, when the blade is folded.

The blade 14 is held in the extended position by a conventional, selectively disengageable locking mechanism which securely holds the blade in this position. A conventional lock release lever 60 is suitably engaged with the locking mechanism such that when the lever 60 is pivoted or pressed downward, the locking mechanism is released, and the blade can be pivoted to the folded position. The fastener 28*b* acts as a pivot point for the lever 60, with the lever 60 being disposed in the channel 30 between the side walls 16,18, thus acting as a spacer for the side walls. Locking and lock release mechanisms of this type are generally well known in the art, and thus not further described herein. Reference is made to U.S. Pat. Nos. 4,805,303 and 5,044,079, the disclosures of which are hereby incorporated by reference, each of which show examples of locking and lock release mechanisms. As shown in FIG. 1, the edge 22 is provided with a concave depression 62 between the two ends 24,26 in order to facilitate pressing of the release lever 60.

The shape of the blade 14 is designed so as to be able to perform multiple tasks. As can be seen, the first edge 50 includes a large, concave portion 64 between the ends of the blade, suitable for acting as a paint roller cleaner. Further, the second edge 52 is entirely curvilinear and includes a concave portion 66 adjacent the first end of the blade, followed by a convex portion 68, which in turn is followed by an additional, larger concave portion 70 which acts as a radius scraper and a utility knife cutting edge. One of the side surfaces, for instance side surface 46, is beveled 72 adjacent to the edge 54 and adjacent a portion of the edge 52 up to approximately the vertex of the convex portion 68, such that a sharpened edge is defined along the orthogonal edge 54 and along a portion of the edge 52, up to approximately the vertex of the convex portion 68, such that the blade can also be used generally as a scraper, spreader, and as a utility knife. The edge 54 extends almost perpendicular to the edge 50 and a radiused portion 74 connects the two edges to form a large radius corner. Further, as can be seen in FIG. 1, the concave portion 70 includes a first part extending from the convex portion 68 and an enlarged, second part connected to the edge 54 by a radiused portion 76. The edge 54 is disposed at an acute angle relative to this enlarged, second concave part such that the radiused portion 76 defines a small radius corner tip, suitable for acting as a crack cleaner point. Note that the portion 76 is disposed well below the level of the vertex of the convex portion 68, such that the tip thereof can reach and fit into tight spaces. Additionally, the portion 78 of the edge 50 located between the concave portion 64 and the corner 74 can function as a paint can opener edge.

Of course, it should be realized that the beveled area 72 could be formed on the side surface 48 without changing the scope of the invention.

Additionally, further members could be pivotally attached to the tool to augment the operation of the blade 14. These members include a screwdriver, a flexible putty blade, a knife blade, an electricians screwdriver blade, and/or a screwdriver can closer blade. These members would be pivotally attached to the handle and be able to fold into the channel, along with the blade 14. Further, a belt clip could be attached to the handle to permit attachment of the tool to the user's belt.

In use, with the blade in its folded position and the knob attached to the side surface 46, the user can simply hold the tool in one hand, and using the same hand, use a thumb or finger to push against the knob 56, aided by the notch 42, so as to pivot the blade to the extended position where it is locked in place. Once the blade is extended, the ergonomic design of the handle aids in using the tool. The finger rest portions 38,39 allow the user to apply increased pressure with thumb and finger during difficult scraping or cutting operations. The concave portion 40 permits easy grasping of the tool in the user's hand. Further, the multi-purpose design of the blade 14 allows the tool 10 to perform many operations, such as scraping, spreading, radius scraping, cleaning paint rollers, cleaning cracks, cutting, and opening cans. When the blade is not being used, the user simply pushes the release lever 60 to unlock the locking mechanism, and using a thumb or finger to push the knob, the blade is pivoted to the folded position, with the knob disposed within the notch 42. For a left handed user, the knob is detached from the surface 46 and reattached to the blade on the surface 48. The notch within the side wall 16 will then receive the knob when the blade is folded and aid the left handed user in actuating the knob.

It is to be understood that while certain embodiments of the present invention have been illustrated and described, the invention is not limited to the specific forms or arrangements of parts described and shown.

What is claimed is:

1. A painter's tool comprising:

an elongate handle having first and second side walls defining first and second edges and first and second ends, and a channel formed between said side walls and extending through said first edge;

an elongate blade secured by a pivot at a first end thereof to the first end of the handle, whereby said blade is pivotable between a folded position within the channel, and an extended position outside of the channel, wherein said blade defines first and second side surfaces, first and second longitudinal edges and an orthogonal edge at a second end of the blade;

a rounded notch formed in each of said side walls at said first edge; and a finger actuation knob secured to one of said side surfaces of the blade adjacent to said first longitudinal edge, whereby when said blade is in the folded position, the finger actuation knob is disposed within one of said rounded notches.

2. The painter's tool according to claim 1, wherein said finger actuation knob is detachably secured to said blade, such that the finger actuation knob is securable to both the first side and second side surfaces.

3. The painter's tool according to claim 1, wherein said finger actuation knob has a knurled outer surface.

4. The painter's tool according to claim 1, wherein said handle is generally tapered from said second end to said first end thereof.

5. The painter's tool according to claim 4, wherein said second handle edge includes a first curvilinear finger rest portion adjacent said first handle end.

6. The painter's tool according to claim 5, wherein said first handle edge includes a second curvilinear finger rest portion adjacent said first handle end and aligned with said first curvilinear finger rest portion.

7. The painter's tool according to claim 6, wherein said first and second curvilinear finger rest portions are concave in shape.

8. The painter's tool according to claim 7, wherein said first handle edge includes an arcuate gripping portion disposed between said rounded notch and said second handle end.

9. The painter's tool according to claim 8, wherein said arcuate gripping portion is concave in shape.

10. The painter's tool according to claim 6, wherein said second curvilinear finger rest portion is disposed between said rounded notch and said first handle end.

11. The painter's tool according to claim 1, further including a hammer cap secured to the second end of the handle.

12. The painter's tool according to claim 1, wherein said second longitudinal blade edge includes a convex portion intermediate the first and second ends thereof, and a first concave portion between the convex portion and the second blade end.

13. The painter's tool according to claim 12, wherein said second longitudinal blade edge includes a second concave portion between said convex portion and said first end of the blade.

14. The painter's tool according to claim 13, wherein said first longitudinal blade edge includes a third concave portion intermediate the first and second ends thereof.

15. The painter's tool according to claim 14, wherein one of said blade side surfaces is beveled adjacent said second blade end and said second longitudinal edge such that a sharpened edge is defined along at least a portion of said orthogonal edge and said second longitudinal edge.

16. The painter's tool according to claim 15, wherein said beveling ends adjacent a vertex of the convex portion such that the sharpened edge ends adjacent the vertex.

17. The painter's tool according to claim 16, wherein said orthogonal edge extends generally perpendicular to said first longitudinal edge and is connected thereto by a first radiused portion so as to define a generally large radius corner.

18. The painter's tool according to claim 17, wherein said first concave portion of said second longitudinal blade edge includes a first portion extending from the convex portion and an enlarged, second portion connected to the orthogonal edge by a second radiused portion, said orthogonal edge being disposed at an acute angle relative to said enlarged, second concave portion such that said second radiused portion defines a small radius corner tip.

19. The painter's tool according to claim 18, wherein said second radiused portion is disposed generally at a level below the vertex of said convex portion when said blade is in the extended position.

20. The painter's tool according to claim 1, further including locking means for locking said blade in said extended position.

21. The painter's tool according to claim 20, further including lock release means for releasing the locking means.

22. A tool comprising:

a handle having first and second side walls defining a first edge, and a channel formed between said side walls and extending through said first edge;

a blade pivotally secured to said handle, said blade being pivotable between a folded position within the channel, and an extended position outside of the channel, and said blade defining first and second side surfaces and a first longitudinal edge;

a notch formed in each of said first and second side walls at said first edge; and an actuation knob detachably secured to said blade adjacent to said first longitudinal edge, and said actuation knob is selectively securable to both said first and second side surfaces.

23. The tool according to claim 22, wherein the notches are rounded.

24. The tool according to claim 20, wherein said finger actuation knob has a knurled outer surface.

25. A tool comprising:

a handle having first and second side walls defining a first edge, and a channel formed between said side walls and extending through said first edge;

a blade pivotally secured to said handle, said blade being pivotable between a folded position within the channel, and an extended position outside of the channel;

a notch formed in each of said first and second side walls at said first edge; and an actuation knob secured to said blade and receivable within one of said notches when said blade is in the folded position.

26. The tool according to claim 25, wherein said actuation knob is detachably secured to said blade.

* * * * *

UNITED STATES PATENT AND TRADEMARK OFFICE

CERTIFICATE OF CORRECTION

PATENT NO. : 5,956,788

DATED : SEPTEMBER 28, 1999

INVENTOR(S) : HENKE

It is certified that error appears in the above-identified patent and that said Letters Patent is hereby corrected as shown below:

Col. 8, line 20, claim 24: "claim 20" should read —claim 22—

Signed and Sealed this

Fifth Day of September, 2000

*Attest:*

*Attesting Officer*

Q. TODD DICKINSON

*Director of Patents and Trademarks*